US005290176A

United States Patent [19]

Soes et al.

[11] Patent Number: 5,290,176

[45] Date of Patent: Mar. 1, 1994

[54] INSULATION DISPLACEMENT CONTACT HAVING BACK UP SPRING

[75] Inventors: Lucas Soes, BB Rosmalen; Franciscus M. Wouters, ZE Hasselt, both of Netherlands

[73] Assignee: The Whitaker Company, Wilmington, Del.

[21] Appl. No.: 987,942

[22] Filed: Dec. 9, 1992

[30] Foreign Application Priority Data

Dec. 20, 1991 [GB] United Kingdom ..... 9127053

[51] Int. Cl.[5] ..... H01R 4/24

[52] U.S. Cl. ..... 439/398

[58] Field of Search ..... 439/389–425

[56] References Cited

U.S. PATENT DOCUMENTS

| | | | |
|---|---|---|---|
| 4,159,158 | 6/1979 | Weidler | 439/398 |
| 4,255,009 | 3/1981 | Clark | 439/398 |
| 4,408,824 | 10/1983 | Weider | 439/398 |
| 4,531,803 | 7/1985 | Hughes | 339/97 R |

*Primary Examiner*—Joseph H. McGlynn
*Attorney, Agent, or Firm*—E. J. Groen

[57] ABSTRACT

An electrical terminal includes an insulation displacement slot formed by two upstanding beams having a slot there between profiled to receive a wire. At an upper portion of the terminal, a wire receiving opening is formed which is profiled to receive an insulated wire, the opening being in transition with, insulation severing surfaces. To increase the reaction forces on the beams, a back-up spring is added to the spring beams, interconnected to the spring beams alongside the wire contact surfaces.

8 Claims, 6 Drawing Sheets

3.0
2.0
1.0
0.0
RESISTANCE (mΩ)
MAX.
MEAN
MIN.
INITIAL
A
B
C
D
E 3.0
2.0
1.0
0.18
0.0
RESISTANCE (mΩ)
MAX.
MEAN
MIN.
INITIAL
A
B
C
D
E

INSULATION DISPLACEMENT CONTACT HAVING BACK UP SPRING

BACKGROUND OF THE INVENTION

1. Field of the Invention

The subject invention relates to an insulation displacement electrical terminal having an improved insulation displacement slot where the electrical terminal has a backup spring.

2. Description of the Prior Art

In general, insulation displacement terminals have three functions. First the electrical terminal must cut through the insulative material surrounding the electrical wire to access the inner conductive core. Second the terminal must achieve a gas tight electrical connection between the inner core or wire and the electrical terminal. Third, the electrical terminal must maintain this gas tight electrical connection during a long period of time, referred to as its ageing period.

A conventional electrical terminal comprises upstanding beams having a narrowing slot for severing the insulation and a wire terminating slot for interference fit with the wire conductor in the insulated wire. Thus, with conventional insulation displacement terminals, the cutting forces are relatively high and thus the resistance force inwardly towards the wire are relatively low due to the distance between the wire and the root of the IDC slot at the time of severing the insulation. Thus, in conventional IDC terminals the beams which form the insulation displacement terminal must be sidewardly supported by a housing in which the terminal resides, or by other such means as a tool or template.

SUMMARY OF THE INVENTION

The object of the invention then is to provide an electrical insulation displacement terminal having improved characteristics such that the beams forming the insulation displacement slot provide a high resistance force against the force of cutting the insulation.

It is further object of the invention to provide a high contact force between the spring beams and the electrical conductor to be terminated.

It is a further object of the invention to provide a free standing electrical insulation displacement terminal such that no backup force by way of a housing or tooling is required to make the termination with the electrical wire.

The objects of the invention were accomplished by providing an electrical terminal comprising an insulation displacement contact having upstanding beams with a slot therebetween formed by sheared edges along a length thereof. The slot has an open upper wire receiving end, and a lower root portion defined by an end of the slot. The slot defines an upper insulation cutting position profiled to cut through the insulation of an insulated wire upon transverse movement into the slot, and a contact position located medially of the root and the open upper end. The terminal is characterized in that the upstanding beams are rigidified adjacent to the cutting position by a backup spring interconnected to the beams via a reversely bent bight portion, and the beams have weakened sections adjacent to the contact position to counteract the backup spring.

DETAILED DESCRIPTION OF THE PREFERRED EMBODIMENT

Figure 1:
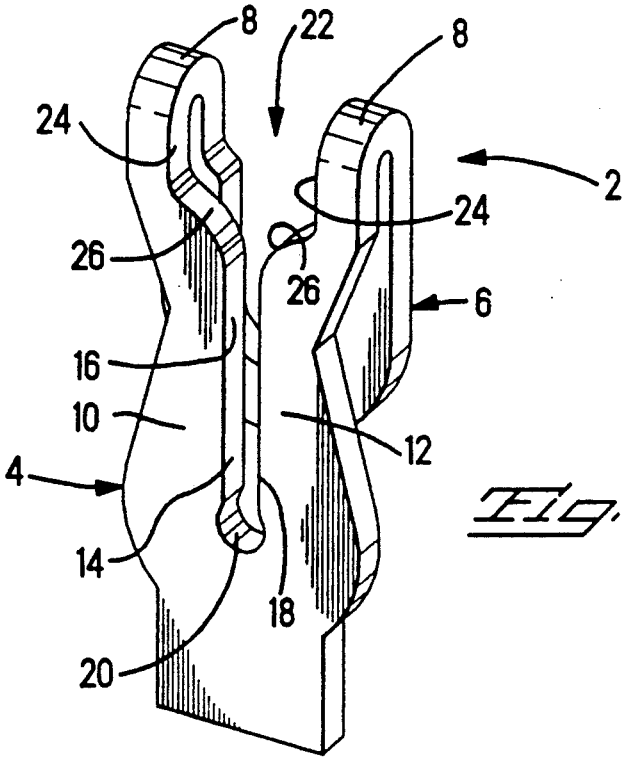
FIG. 1 is an isometric view of the insulation displacement slot from the side showing the wire contacting slot only.

With reference first to FIG. 1, an electrical insulation displacement portion of an electrical terminal is shown generally at 2 comprising a first spring portion 4 interconnected to a second spring portion 6 interconnected by a folded over bight portion at 8. The spring portion 4 is comprised of first and second upstanding beams 10 and 12 having a slot 14 formed therebetween formed by sheared edges 16 and 18. At the root of the slot 14 is an enlarged portion 20 to relieve the stresses in the individual plate portions 10 and 12.

A wire receiving opening 22 is formed at the upper vertical location of the terminal intermediate the sheared side edges 24 at the upper location of the two spring beams 10 and 12. Radiused insulation cutting surfaces 26 are formed in continuation with the side edges 24 and with the sheared slot surfaces 16 and 18.

Figure 2:
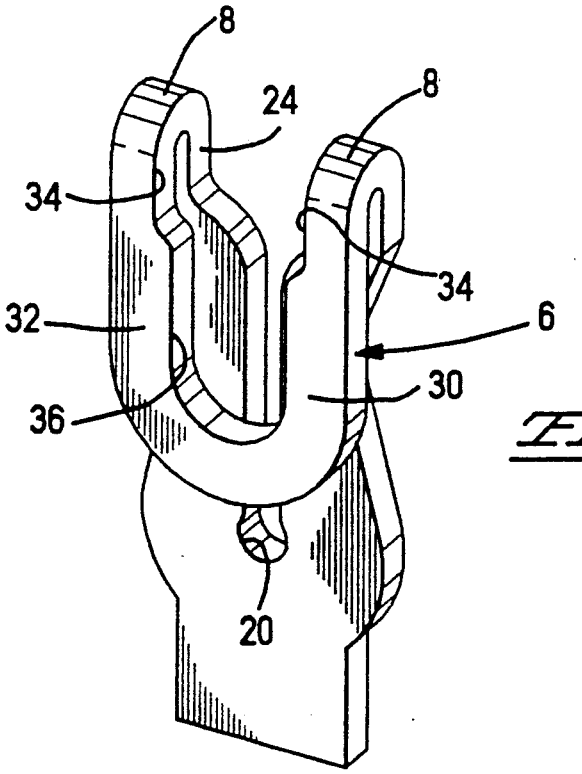
FIG. 2 is an isometric view of the insulation displacement terminal showing the terminal from the side having the backup spring.

As shown best in FIG. 2, the backup spring 6 comprises a U-shaped spring portion comprising two spring beams 30 and 32 integral with spring arms 10 and 12 respectively. It should be noted that the backup spring 6 includes sheared surfaces 34 substantially co-planer with sheared surfaces 24 to form the wire opening 22, and further comprises a U-shaped inner sheared surface 36 thereby forming a wire receiving trough.

Figure 3:
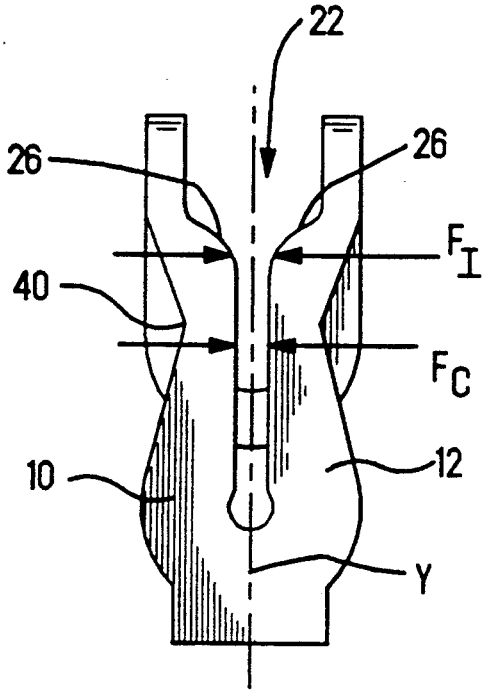
FIG. 3 is a front plan view of the electrical terminal shown in in FIG. 1.
Figure 4:
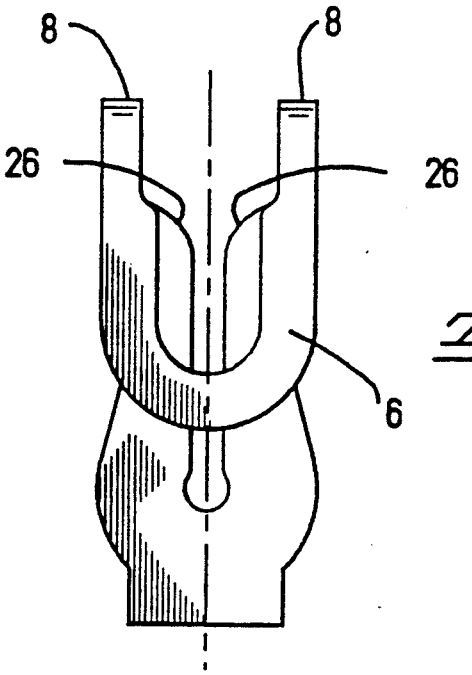
FIG. 4 is a rear plan view of the electrical terminal shown in FIG. 2.

With reference now to FIGS. 3 and 4 the operation of the insulation displacement terminal will be described in greater detail. With reference first to FIG. 3, vertical movement downward of an insulated wire along the Y-axis causes a contact with the insulation cutting surfaces 26 causing a force against the beams 10 and 12 at an upper location, as shown in FIG. 3, and the spring beams 10 and 12 resist this outward force with a reaction force F(I) as shown in FIG. 3. It should be appreciated that the backup spring 6 interconnected at the bight portion 8 greatly adds to this resistance force F(I).

Continued vertical downward movement of the insulated wire causes a complete cutting through of the insulation at the position of the sheared edges 16, 18 (FIG. 1) and causes an interference fit electrical contact against the sheared surfaces 16, 18. As the contact between the sheared edges 16, 18 is an interference fit, the conductor causes an outward force against the spring beams 10, 12 and the spring beams cause an inner reactive contact force F(C) as shown in FIG. 3 against the conductor.

Adding the backup spring 6 to the electrical terminal, while advantageously adding to the reactive force F(I), also adds to the reactive force F(C) against the conductor, which could be a disadvantage to the wire connection, for example with stranded wire where there is a possibility of shearing through some of the strands. This reactive force F(C) has been increased so much by the addition of the backup spring 6, that material must be removed form the spring beams 10 and 12 for example at 40 as shown in FIG. 3.

In the preferred embodiment of the invention, the spring beams 10,.12 are "tuned" by way of the cutout portions 40, such that their lateral forces are again equal to their original value without the backup spring. This tuning, or weakening of the spring beams 10,12, has the advantage of an increased elasticity at the contact position, thereby improving the aging behaviour.

Figure 5:
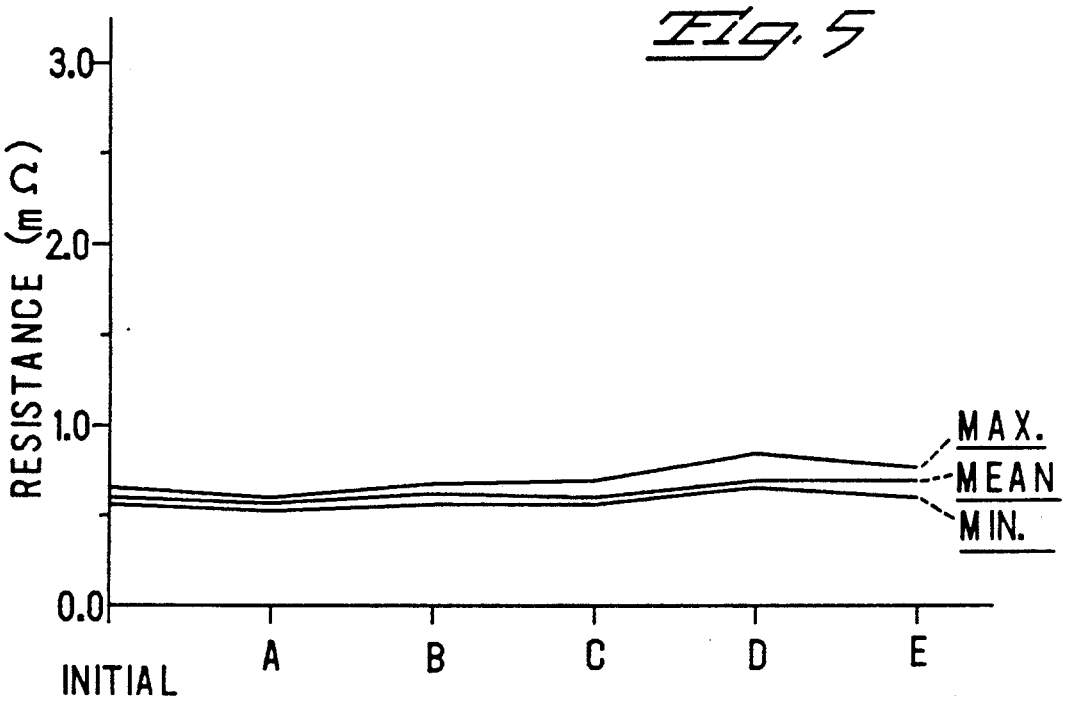
FIGS. 5 and 6 show graphs representing test results of two separate samples made pursuant to the invention described herein.
Figure 6:
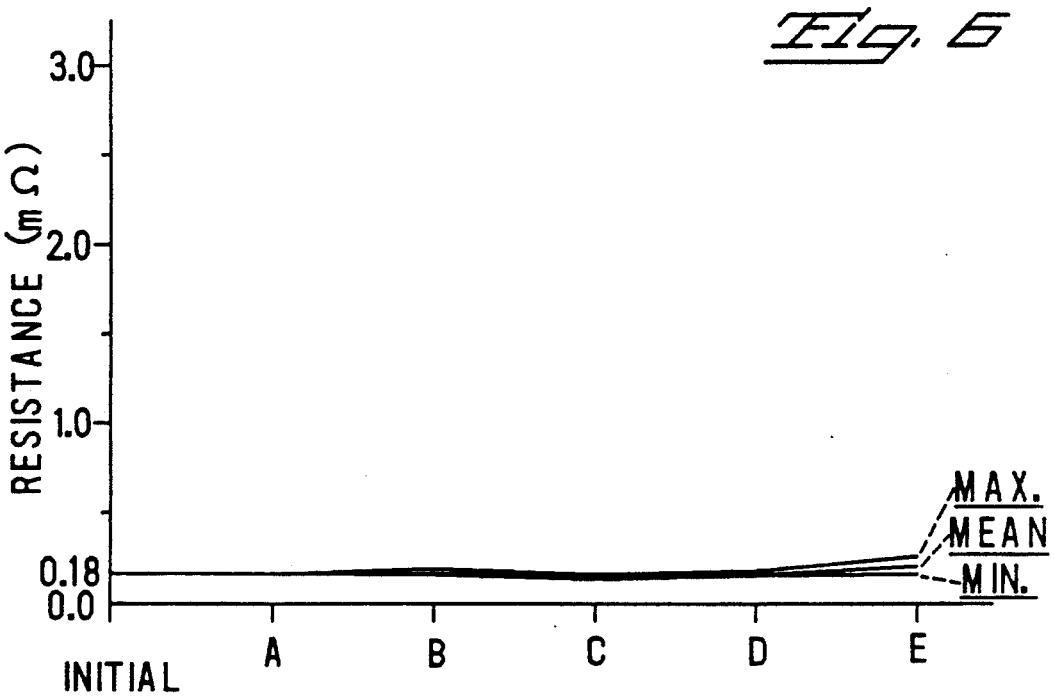

FIGS. 5 and 6 show graphs representing test results of two separate insulation displacement samples made pursuant to the teaching of the invention above. With reference first to FIG. 5, this curve represents the test results of an electrical wire having a diameter of 0.35 $mm^2$ with 19 strands and coated with teflon. The vertical access of the curve is the resistance in mΩ the X-axis refers to time and various testing which occurred during the life of an electrical connection. The testing at position A is a thermal shock from minus 40° C. to plus 150° C. Position B shows a dry heat test of 150° C. for 1000 hours. Position C shows an ageing at 2500 hours whereas at position C is ageing at 4000 hours. Finally position E shows a second thermal shock from −40° C. to +150° C. After the test was completed the mean change in resistance was 0.08 mΩ, the maximum change in resistance was 0.23 mΩ and the minimum change in resistance was a −0.01 mΩ.

With respect now to FIG. 6 the curve shows the results of a power contact terminated to an insulative conductor of 4.0 $mm^2$ having 58 stranded conductors. The test at position A shows a thermal shock from −40° to +120° C. Position B shows a temperature change test from a −40° C. to +100° C. Position C shows a dry heat test at 120° C. for 120 hours. Position D shows a salt spray for 4 hours, and position E shows a mixed flowing gas test for 21 days where the gas comprises a combination of SO2, H2S, NO2, and CL2.

Figure 8:
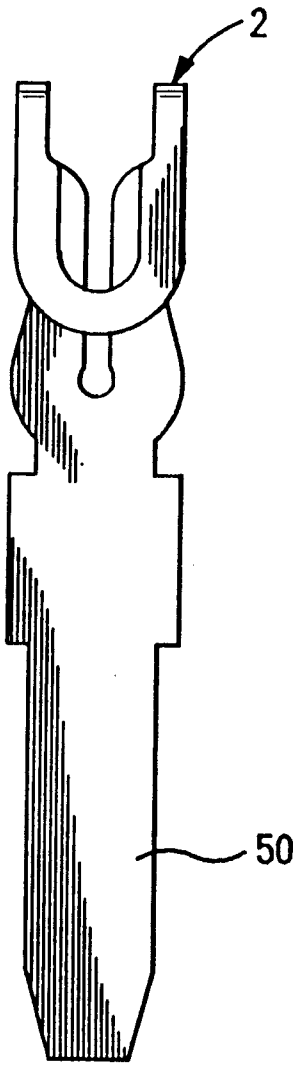
FIGS. 7 and 8 show embodiments of the electrical insulation displacement slot configured as an electrical tap connector.
Figure 7:
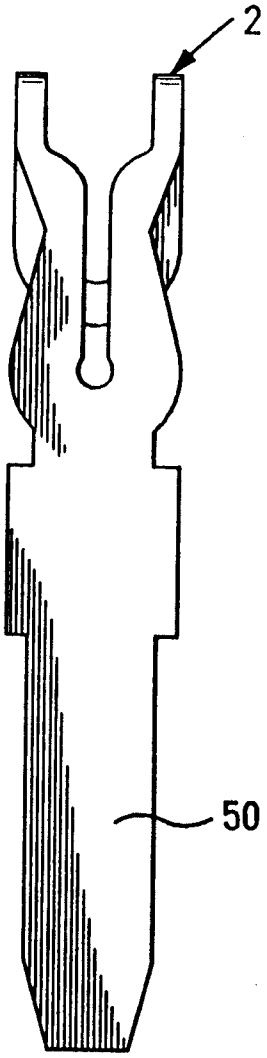

Advantageously then the insulation displacement terminal can be useful in several configurations, for example as shown in FIGS. 7 and 8 the insulation displacement terminal 2 can be interconnected to a tab at 50 to form a wire tap type electrical terminal.

Figure 9:
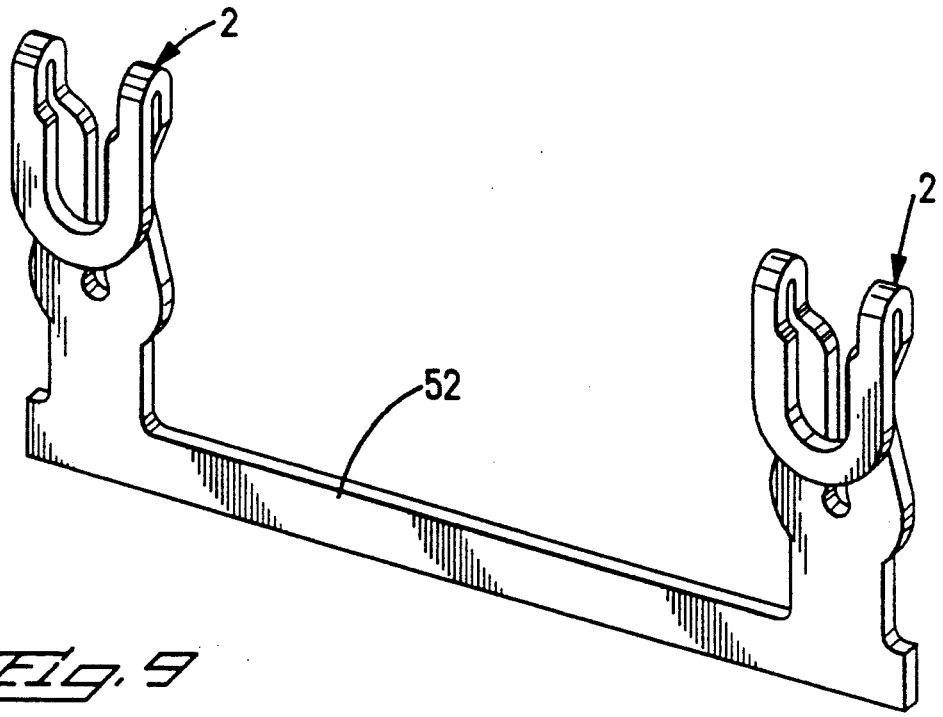
FIGS. 9 and 10 show embodiments of the electrical insulation displacement slot configured as a wire splicing mechanism.
Figure 10:
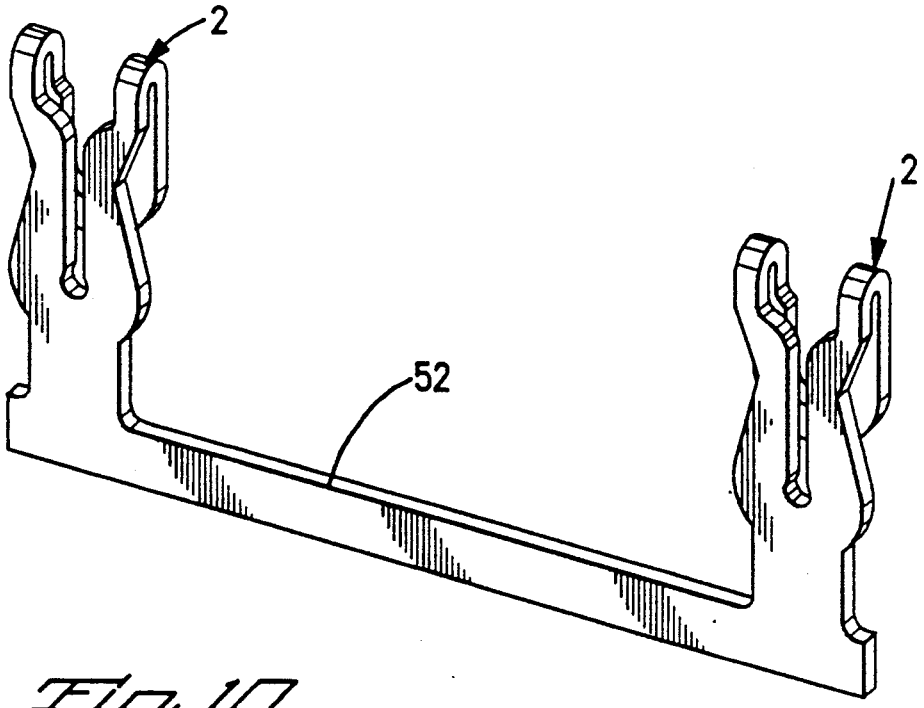

As shown in FIGS. 9 and 10, an assembly is shown for commoning to electrical wires having two of the electrical terminals 2 integrally and electrically interconnected by way of a commoning bar 52. It should be appreciated that any number of electrical terminals 2 could be provided on such a bus bar depending on the number of wires to be commoned.

Figure 11:
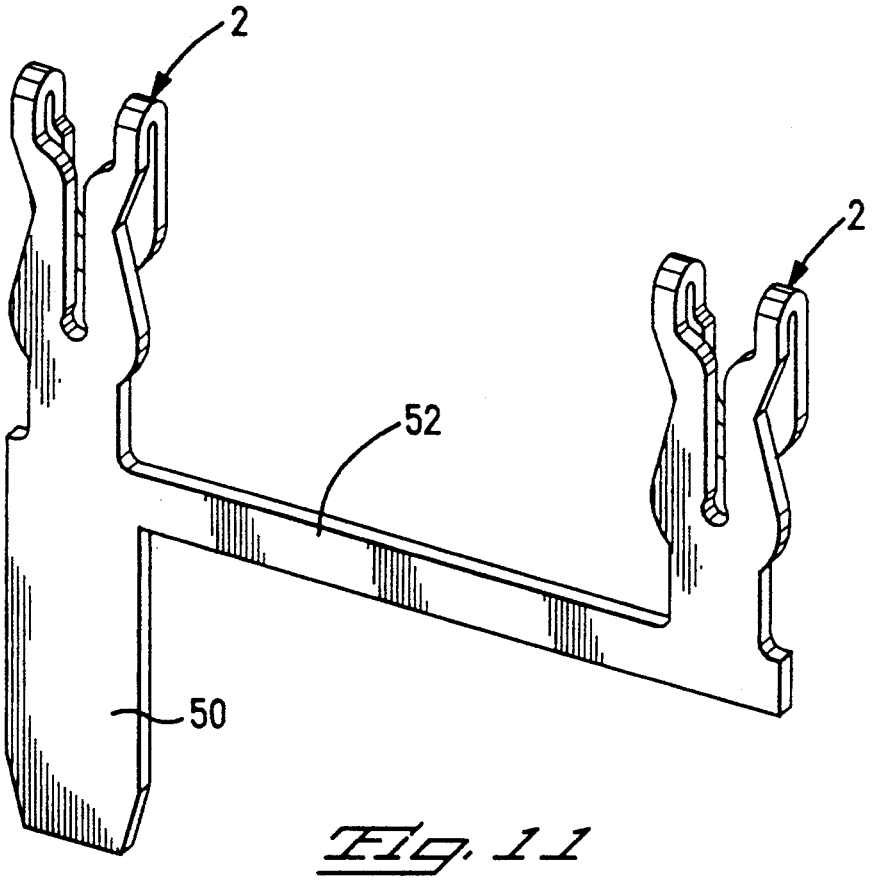
FIG. 11 shows an embodiment of the electrical connector configured as a wire tap and wire splice electrical terminal.

As shown in FIG. 11, a combination of the electoral terminals shown in FIGS. 5, 6 and 7, 8 is also available where insulation displacement terminals 2 are commoned together by way of a commoning bar 52 and the commoning bar includes an integral tab portion 50 which provides a wire to wire tab electrical terminal assembly.

We claim:

1. An electrical terminal comprising an insulation displacement contact having upstanding beams with a slot therebetween formed by sheared edges along a length thereof, said slot having an open upper wire receiving end, and a lower root portion defined by an end of sad slot, said slot defining an upper insulation cutting position profiled to cut through the insulation of an insulated wire upon transverse movement into said slot, and a contact position located medially of said root and said open upper end, the contact being characterized in that:

said upstanding beams are rigidifed at said cutting position by a backup spring interconnected to said beams via a reversely bent bight portion, said backup spring comprising spring beams interconnects at ends thereof, said spring beams being spaced apart a distance greater than said slot, to receive an insulated wire therein.

2. The electrical terminal of claim 1, characterized in that said weakened sections are defined by reducing the cross-sectional area of said beams.

3. The electrical terminal of claim 1, characterized in that said weakened sections are defined by narrowed sections of said beams.

4. The electrical terminal of claim 1, characterized in that insulation displacement contact is interconnected to a tab portion.

5. The electrical terminal of claim 1 characterized in that said upstanding beams having weakened sections adjacent to said contact position to counteract said backup spring.

6. The electrical terminal of claim 1 characterized in that said backup spring is generally U-shaped.

7. The electrical terminal of claim 1, characterized in that two insulation displacement contacts are interconnected to each other by way of a bus bar portion intermediate the two.

8. The electrical terminal of claim 7, characterized in that said bus bar portion further comprises a tab portion extending therefrom defining an interconnection member for a mating receptacle.

* * * * *